US008833560B2

(12) United States Patent
Shih

(10) Patent No.: US 8,833,560 B2
(45) Date of Patent: Sep. 16, 2014

(54) PACKING CUSHION

(71) Applicant: Wan-Ling Shih, New Taipei (TW)

(72) Inventor: Wan-Ling Shih, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/664,437

(22) Filed: Oct. 31, 2012

(65) Prior Publication Data

US 2013/0240403 A1 Sep. 19, 2013

(30) Foreign Application Priority Data

Mar. 16, 2012 (CN) ..... 2012 2 0098829 U

(51) Int. Cl.
*B65D 81/02* (2006.01)
*B65D 81/05* (2006.01)

(52) U.S. Cl.
CPC ..... *B65D 81/058* (2013.01)
USPC ..... 206/592; 206/521; 206/586

(58) Field of Classification Search
CPC .. B65D 5/5038; B65D 5/5069; B65D 81/058; B65D 81/113; B65D 2581/05; B65D 2581/051; B65D 2581/052; B65D 2581/053; B65D 2581/055
USPC ..... 206/521, 586, 588, 591, 592, 593, 594
See application file for complete search history.

(56) References Cited

U.S. PATENT DOCUMENTS

| | | | | |
|---|---|---|---|---|
| 6,082,546 | A * | 7/2000 | Liao et al. | 206/592 |
| 6,405,873 | B2 * | 6/2002 | Koike | 206/592 |
| 6,877,608 | B2 * | 4/2005 | Koike | 206/592 |
| 7,044,303 | B2 * | 5/2006 | Van Der Werf | 206/586 |
| 8,047,370 | B2 * | 11/2011 | Ma et al. | 206/592 |
| 8,047,371 | B2 * | 11/2011 | Li et al. | 206/592 |
| 2011/0005964 | A1 * | 1/2011 | He et al. | 206/592 |
| 2013/0048534 | A1 * | 2/2013 | Merrell et al. | 206/591 |

* cited by examiner

*Primary Examiner* — Bryon Gehman
(74) *Attorney, Agent, or Firm* — Novak Druce Connolly Bove + Quigg LLP

(57) ABSTRACT

A packing cushion includes a base and a plurality of sidewalls coupled to the base. An inner surface of one of the plurality of sidewalls defines at least one first protruding block. An inner surface of the base defines at least one second and third protruding blocks. Each of the at least one third protruding block protrudes from an end of the at least one second protruding block. The at least one first protruding block contacts with the object to act as a cushion in a first direction. The at least one third protruding block supports the object and is capable of cooperating with the at least one second protruding block to provide a second cushioning in a second direction perpendicular to the first direction for the object.

15 Claims, 4 Drawing Sheets

PACKING CUSHION

BACKGROUND

1. Technical Field

The present disclosure relates to packing cushions for stabilizing an object when packed.

2. Description of Related Art

Many products require to be boxed up for shipping and storage. However, some of these products are frangible and easily damaged during shipping if packed in a box without filler or padding. Therefore, packing cushions are needed in the boxes to protect the products.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
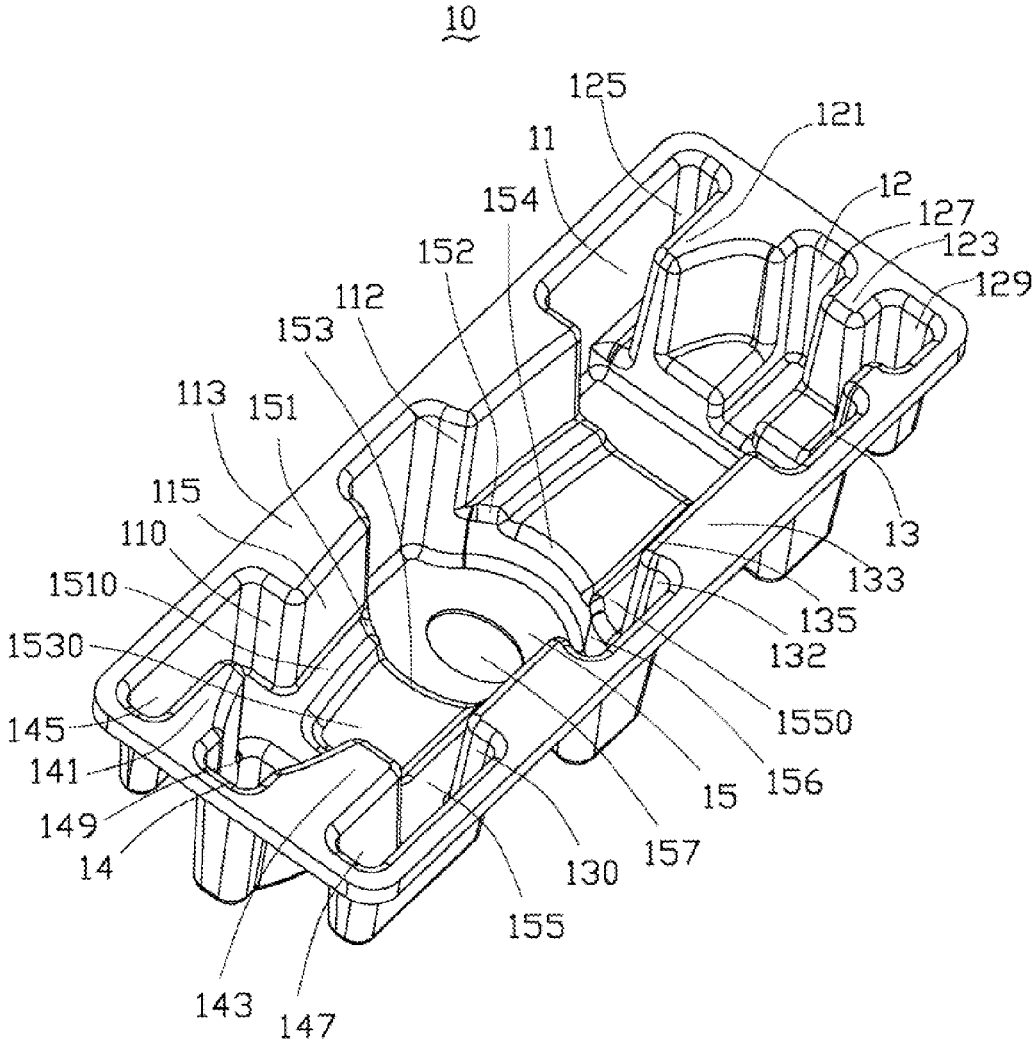
FIG. 1 is a perspective view of a packing cushion in accordance with one embodiment.
Figure 2:
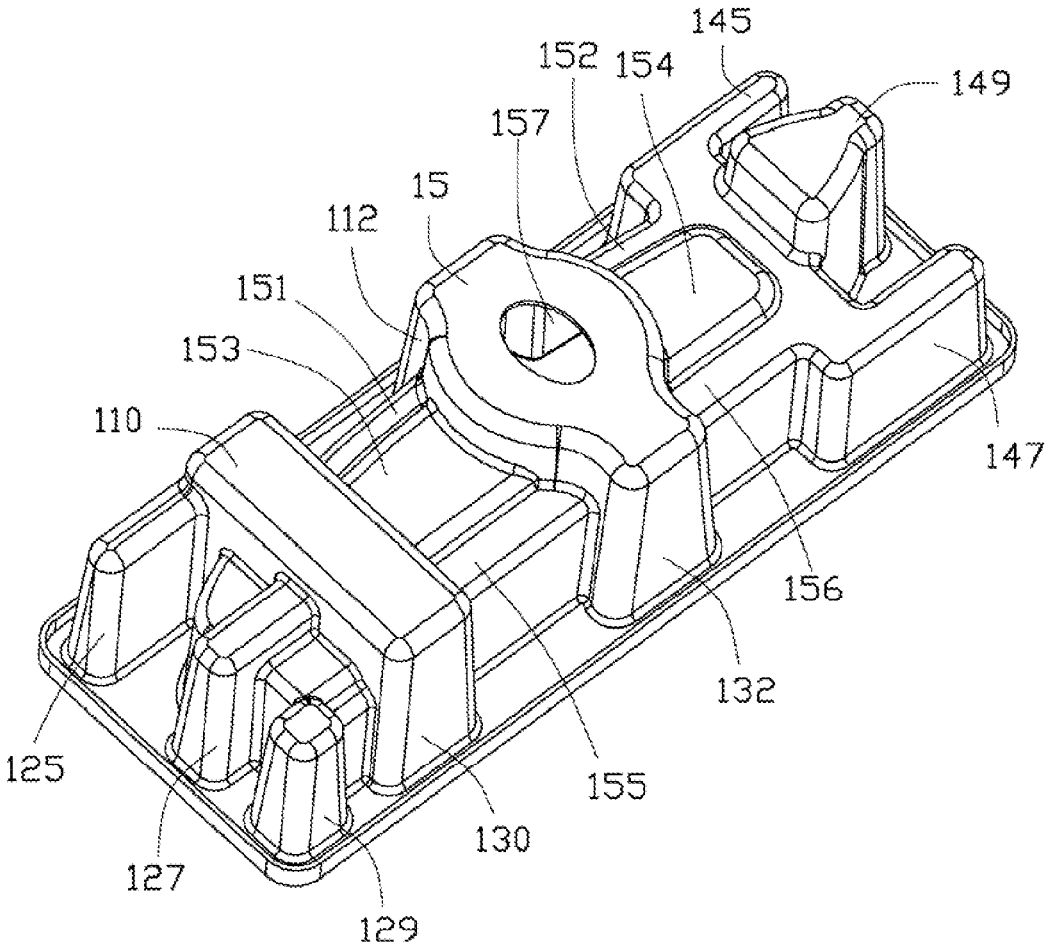
FIG. 2 is similar to FIG. 1, but viewed from another aspect.

Referring to FIGS. 1 and 2, a packing cushion 10 in accordance with an embodiment is shown. The packing cushion 10 can be used in boxes or other shipping containers to protect objects from shocks and vibrations during shipping, e.g., to protect an electronic device (not shown). The packing cushion 10 is made of flexible materials. In the embodiment, the packing cushion 10 is made of pulp based material such as cardboard.

The packing cushion 10 is substantially a hexahedron. The packing cushion 10 includes a rectangular base 15 and four sidewalls (hereinafter, a first sidewall 11, a second sidewall 12, a third sidewall 13, and a fourth sidewall 14) protruding from four rims of the base 15. The first sidewall 11, the second sidewall 12, the third sidewall 13 opposite to the first sidewall 11, and the fourth sidewall 14 opposite to the second sidewall 12 define an accommodating space to receive all or at least a part of an electronic device.

Two first protruding blocks 110, 112 protrude from an inner surface of the first sidewall 11. The first protruding blocks 110, 112 connect to the base 15 and are spaced apart from each other. The first protruding block 110 is adjacent to the fourth sidewall 14. The first protruding block 112 is adjacent to the second sidewall 12. The first protruding blocks 110, 112 all include a first planar surface 113 opposite to the base 15 and a first contacting surface 115 opposite to the third sidewall 13.

Two first protruding blocks 130, 132 protrude from an inner surface of the third sidewall 13. The first protruding blocks 130, 132 correspond to the first protruding blocks 110, 112 respectively, and cooperate with the first protruding blocks 110, 112 to provide cushioning for the electronic device along a first direction substantially perpendicular to the first sidewall 11. The first protruding blocks 130, 132 all include a first planar surface 133 opposite to the base 15 and a second contacting surface 135 opposite to the first sidewall 11.

Two second protruding blocks 153, 154 protrude from the base 15. The second protruding block 153 is arranged between the first protruding blocks 110, 130. The second protruding block 154 is arranged between the first protruding blocks 112, 132. Two third protruding blocks 151, 152 protrude from opposite ends of the second protruding blocks 153 and connect with the first protruding blocks 110, 130 respectively. Two third protruding blocks 155, 156 protrude from opposite ends of the second protruding blocks 154 and connect with the first protruding blocks 112, 132 respectively. The second and third protruding blocks 153, 154,151, 152, 155 and 156 cooperate to provide cushioning for the electronic device along a second direction substantially perpendicular to the base 15.

The first protruding blocks 110, 112 cooperatively define a first contour (not labeled). The first protruding blocks 130, 132 cooperatively define a second contour (not labeled). The first and second contours mate with opposite sides of the electronic device to provide cushioning for the electronic device. The third protruding blocks 151, 152, 155, 156 and two second protruding blocks 153, 154 cooperatively define a depression (not labeled) for receiving part of the electronic device.

The second protruding blocks 153, 154 all include a second planar surface 1530 opposite and parallel to the base 15. The third protruding blocks 151, 152 all include a third planar surface 1510 opposite and parallel to the base 15. The third protruding blocks 155, 156 all include a third planar surface 1550 opposite and parallel to the base 15. Each third planar surface 1510 is parallel to the first and second planar surfaces 113, 1530. Each third planar surface 1550 is parallel to the first and second planar surfaces 133, 1530. The distance between the base 15 and the third planar surfaces 1510 is smaller than the distance between the base 15 and the first planar surfaces 113, but is larger than the distance between the base 15 and the second planar surface 1530. Thus, the first protrusions 110, 112, the second protrusions 153, 154, and the third protrusions 151, 152 are formed into steps with respect to the base 15. The distance between the base 15 and the third planar surfaces 1550 is smaller than the distance between the base 15 and the first planar surfaces 113, but is larger than the distance between the base 15 and the second planar surface 1530. Thus, the first protrusions 130, 132, the second protrusions 153, 154, and the third protrusions 155, 156 are also formed into steps with respect to the base 15.

A plurality of protrusions 121,123 protrude from an inner surface of the second sidewalls 12, and a plurality of protrusions 141, 143 protrude from an inner surface of the second sidewall 14. The protrusions 121, 123, 141, 143 are also connected to the base 15. The protrusions 121, 123 cooperatively define a third contour (not labeled), and the protrusions 141, 143 cooperatively define a fourth contour (not labeled). The third and fourth contours match with opposite ends of the electronic device to be cushioned the electronic device to provide cushioning for the electronic device along a third direction substantially perpendicular to the second and fourth sidewalls 12, 14.

The first and second sidewalls 11, 12, the protrusion 121, and the first protruding block 112 cooperatively define a first receiving space 125. The protrusions 121, 123 cooperatively define a second receiving space 127. The second and third sidewalls 12, 13, and the protrusion 123 cooperatively define a third receiving space 129.

The structure of the fourth sidewall 14 is similar to that of the second sidewall 12. The first and fourth sidewalls 11, 14, the protrusion 141, and the first protruding block 110 cooperatively define a fourth receiving space 145. The fourth and third sidewalls 14, 13, and the protrusion 143 cooperatively define a fifth receiving space 147. The first, second, third, fourth and fifth receiving spaces 125, 127, 129, 145, and 147 are substantially hollow cylinders, and receive the ends of the to be cushioned electronic device. The protrusions 141, 143 cooperatively define a recess 149 for receiving the electronic device and provide a cushioning space for the electronic device in third direction.

An opening 157 is defined at the bottom of the base 15 for allowing the user to grasp the packing cushion 10. The opening 157 is arranged between the second protruding blocks 153 and 154.

In use, the electronic device is received between the first protruding blocks 110, 112, 130 and 132, with opposite sides abutting the first and second contacting surfaces 115, 135. The electronic device further abuts the third protruding blocks 151, 152, 155, 156.

When there is an impact or shock, the electronic device presses against the first and third sidewalls 11, 13 in the first direction, the first protruding blocks 110, 112, 130 and 132 deform to absorb energy of impact for protecting the electronic device. When the electronic device presses the base 15 in the second direction, the third protruding blocks 151, 152, 155 and 156 deform to absorb energy of impact for a first cushioning. The second protruding blocks 153, 154 adapt to absorb energy of the impact for a second cushioning for protecting the electronic device. When the electronic device is forced against the second and fourth sidewalls 12, 14 in the third direction, the protrusions 121, 123, 141 and 143 deform to absorb energy of impact for protecting the electronic device. The recess 149 provides a cushioning space for the electronic device.

Therefore, by virtue of the packing cushion 10, the object is protected from shocks and vibrations in any directions.

The number of the first, second and third protruding blocks 110, 112, 130, 132, 151, 152, 153, 154, 155, 156 are changeable according to a shape of the electronic device to be packed.

Figure 3:
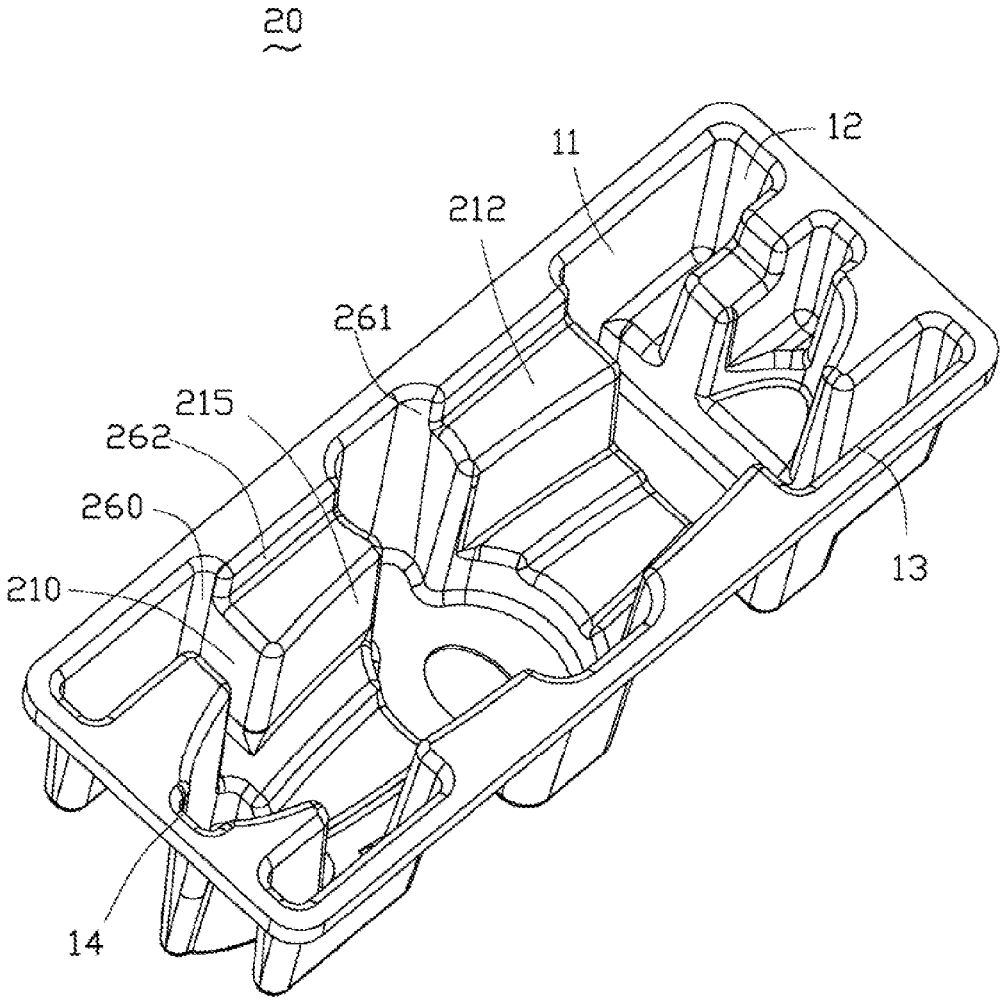
FIG. 3 is a perspective view of a packing cushion in accordance with another embodiment.
Figure 4:
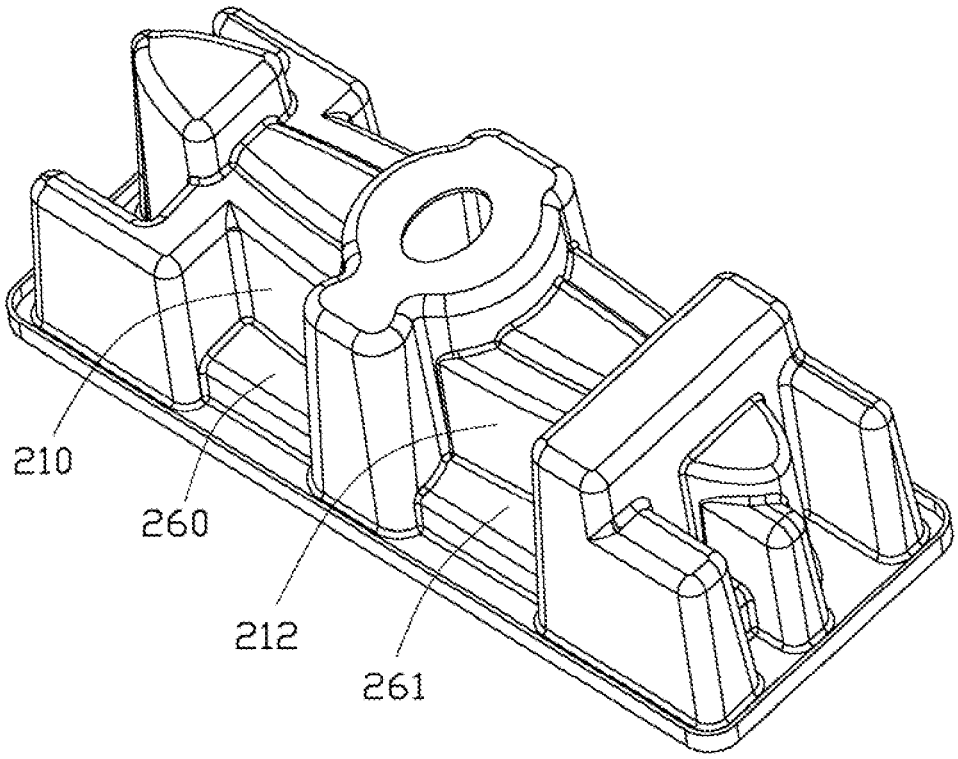
FIG. 4 is similar to FIG. 3, but viewed from another aspect.

Referring to FIGS. 3 and 4, a packing cushion 20 in accordance with another embodiment is shown. The packing cushion 20 is similar to the packing cushion 10. The difference between the packing cushion 20 and the packing cushion 10 is that a portion of the ends of the first protruding blocks 110, 112 away from the base 15 is cut away to define two cutouts 260, 261. The two cutouts 260, 261 all include a fourth planar surface 262 opposite to the third sidewall 13. The first protruding blocks 210, 212 include a first contacting surface 215 opposite to the third sidewall 13. The fourth planar surfaces 262 are coplanar to each other. The distance between the fourth planar surface 262 and the first sidewall 11 is smaller than the distance between the fourth planar surfaces 215 and the first sidewall 11. Thus, the first protruding blocks 210, 212 and the cutouts 260, 261 form a ladder-shape with respect to the first sidewall 11.

When the container of the electronic device is subjected to an impact and the electronic device presses the first sidewall 11 in the first direction, the first protruding blocks 210, 212 deform to absorb energy of impact for a first cushioning. The cutouts 260, 261 adapt to absorb energy of the impact for a second cushioning for protecting the electronic device.

Although information and the advantages of the present embodiments have been set forth in the foregoing description, together with details of the structures and functions of the present embodiments, the disclosure is illustrative only; changes may be made in detail, especially in the matters of shape, size, and arrangement of parts within the principles of the present embodiments to the full extent indicated by the broad general meaning of the terms in which the appended claims are expressed.

What is claimed is:

1. A packing cushion, the packing cushion comprising:

a base; and a plurality of sidewalls coupled to the base;

wherein an inner surface of one of the plurality of sidewalls defines at least one first protruding block, an inner surface of the base defines at least one second protruding block and at least one third protruding block, each of the at least one third protruding block protrudes from an end of the at least one second protruding block; the at least one first protruding block provides a cushion in a first direction when being deformed, the at least one third protruding block is capable of cooperating with the at least one second protruding block to provide a first cushion in a second direction perpendicular to the first direction; the at least one second protruding block deforms for providing a second cushion in the second direction after the at least one third protruding block is completely deformed.

2. The packing cushion of claim 1, wherein two inner surfaces of two opposite sidewalls of the plurality of sidewalls define at least one protrusion respectively, a contour defined by the at least one protrusion for providing a cushion along a third direction perpendicular to the first and second directions.

3. The packing cushion of claim 2, wherein an inner surface of one of the plurality of sidewalls defines a recess to provide a cushioning space in the third direction.

4. The packing cushion of claim 1, wherein the at least one first protruding block includes a first planar surface opposite to the base, the at least one second protruding block includes a second planar surface opposite to the base, and the at least one third protruding block includes a third planar surface opposite to the base; the distance between the base and the third planar surface is smaller than the distance between the base and the first planar surface, and the distance between the base and the third planar surface is larger than the distance between the base and the second planar surface, for providing cushioning.

5. The packing cushion of claim 4, wherein the corresponding at least one first, second and third protruding blocks connect to each other and form into steps with respect to the base.

6. The packing cushion of claim 1, wherein an opening is defined at the base for allowing a user to take hold of the packing cushion; the packing cushion comprises two second protruding blocks and the opening is arranged between the two second protruding blocks.

7. A packing cushion, the packing cushion comprising:

a base; and a plurality of sidewalls coupled to the base;

wherein an inner surface of a corresponding one of the plurality of sidewalls defines at least one first protruding block and at least one cutout, an inner surface of the base defines at least one second protruding block and at least one third protruding block; each of the at least one first protruding block is arranged between the at least one cutout and the at least one third protruding block, each of the at least one third protruding block protrudes from an end of the at least one second protruding block; the at least one first protruding block and the at least one cutout are capable of providing two cushions in a first direction, the at least one third protruding block is capable of cooperating with the at least one second protruding block to provide a first cushion in a second direction perpendicular to the first direction, the at least one second protruding block deforms for providing a second cushion in the second direction after the at least one third protruding block is completely deformed.

8. The packing cushion of claim 7, wherein the at least one cutout is cut by a portion of an end of the at least one first protruding block away from the base.

9. The packing cushion of claim 7, wherein two inner surfaces of two opposite sidewalls of the plurality sidewalls define at least one protrusion respectively, a contour defined by the at least one protrusion for providing a cushion along a third direction perpendicular to the first and second directions.

10. The packing cushion of claim 9, wherein an inner surface of one of the plurality of sidewalls defines a recess to provide a cushioning space in the third direction.

11. The packing cushion of claim 7, wherein the at least one first protruding block includes a first planar surface opposite to the base, the at least one second protruding block includes a second planar surface opposite to the base, and the at least one third protruding block includes a third planar surface opposite to the base; the distance between the base and the third planar surface is smaller than the distance between the base and the first planar surface, and the distance between the base and the third planar surface is larger than the distance between the base and the second planar surface, for providing cushioning.

12. The packing cushion of claim 7, wherein the at least one first protruding block includes a first contacting surface opposite to the corresponding sidewall, the at least one cutout includes a second contacting surface opposite to the corresponding sidewall; the distance between the corresponding sidewall and the first contacting surface is larger than the distance between the corresponding sidewall and the second contacting surface, for providing cushioning.

13. The packing cushion of claim 7, wherein the corresponding at least one first, second and third protruding blocks and the at least one cutout connect to each other and form into a ladder-shape with respect to the base.

14. The packing cushion of claim 7, wherein the at least one first protruding block and the at least one cutout connect to each other and form into a step with respect to the sidewall where the at least one first protruding block is protruded.

15. The packing cushion of claim 7, wherein an opening is defined at the base for allowing a user to grasp the packing cushion; the packing cushion comprises two second protruding blocks and the opening is arranged between the two second protruding blocks.

* * * * *